US005436609A

United States Patent [19]

Chan et al.

[11] Patent Number: 5,436,609

[45] Date of Patent: Jul. 25, 1995

[54] ELECTRICAL DEVICE

[75] Inventors: Chi-Ming Chan, Cupertino; Shou-Mean Fang, Union City, both of Calif.

[73] Assignee: Raychem Corporation, Menlo Park, Calif.

[21] Appl. No.: 87,017

[22] Filed: Jul. 6, 1993

Related U.S. Application Data

[63] Continuation of Ser. No. 837,527, Feb. 18, 1992, which is a continuation-in-part of Ser. No. 590,114, Sep. 28, 1990, Pat. No. 5,089,801.

[51] Int. Cl.[6] ..... H01C 7/10

[52] U.S. Cl. ..... 338/22 R; 338/22 SD; 338/51

[58] Field of Search ..... 338/22 R, 225 D, 51, 338/52, 57

[56] References Cited

U.S. PATENT DOCUMENTS

| | | | |
|---|---|---|---|
| 3,617,816 | 11/1971 | Riseman et al. | 317/234 R |
| 4,237,441 | 12/1980 | van Konynenburg et al. | 338/22 |
| 4,238,812 | 12/1980 | Middleman et al. | 361/106 |
| 4,255,698 | 3/1981 | Simon | 320/35 |
| 4,272,471 | 6/1981 | Walker | 264/104 |
| 4,304,987 | 12/1981 | van Konynenburg | 219/553 |
| 4,315,237 | 2/1982 | Middleman et al. | 338/22 |
| 4,317,027 | 2/1982 | Middleman et al. | 219/553 |
| 4,330,703 | 5/1982 | Horsma et al. | 219/553 |
| 4,346,285 | 8/1982 | Nakamura et al. | 338/22 R |
| 4,388,607 | 6/1983 | Toy et al. | 338/22 |
| 4,414,052 | 11/1983 | Habata et al. | 156/273.7 |
| 4,426,633 | 1/1984 | Taylor | 338/25 |
| 4,475,138 | 10/1984 | Middleman et al. | 361/58 |
| 4,514,620 | 4/1985 | Cheng et al. | 219/553 |
| 4,534,889 | 8/1985 | van Konynenburg et al. | 252/511 |
| 4,545,926 | 10/1985 | Fouts, Jr. et al. | 252/511 |
| 4,560,498 | 12/1985 | Horsma et al. | 252/511 |
| 4,591,700 | 5/1986 | Sopory | 219/505 |
| 4,639,818 | 1/1987 | Cherian | 361/106 |
| 4,654,511 | 3/1987 | Horsma et al. | 219/548 |
| 4,689,475 | 8/1987 | Matthiesen | 219/553 |
| 4,724,417 | 2/1988 | Au et al. | 338/22 |
| 4,774,024 | 9/1988 | Deep et al. | 252/511 |
| 4,780,598 | 10/1988 | Fahey et al. | 219/511 |
| 4,800,253 | 1/1989 | Kleiner et al. | 219/553 |
| 4,845,838 | 7/1989 | Jacobs et al. | 29/671 |
| 4,904,850 | 2/1990 | Claypool et al. | 219/548 |
| 4,907,340 | 3/1990 | Fang et al. | 29/610.1 |
| 4,924,074 | 5/1990 | Fang et al. | 219/548 |
| 4,954,696 | 9/1990 | Ishii et al. | 219/548 |
| 5,049,850 | 9/1991 | Evans | 338/22 R |

FOREIGN PATENT DOCUMENTS

| | | | |
|---|---|---|---|
| 363746 | 4/1990 | European Pat. Off. . | |
| 2838508 | 3/1980 | Germany | H01C 7/02 |

OTHER PUBLICATIONS

Supplementary European Search Report, dated Feb. 21, 1994, for European Patent Application No. 91918254.3.

Patent Abstracts of Japan, vol. 14, No. 557 (E-1011), Dec. 11, 1990 (abstract for Japanese Patent Publication No. 2421001, Sep. 25, 1994 (Matsushita)).

Patent Abstracts of Japan, vol. 14, No. 170 (E-913), Mar. 30, 1990 (abstract for Japanese Patent Publication No. 2027709, Jan. 30, 1990 (Sumitomo)).

*Primary Examiner*—Marvin M. Lateef

*Attorney, Agent, or Firm*—Marguerite E. Gerstner; Timothy H. P. Richardson; Herbert G. Burkard

[57] ABSTRACT

An electrical device in which a conductive terminal is physically and electrically attached directly or indirectly to a face of a laminar PTC resistive element. The terminal comprises a laminar portion and a non-laminar shaped portion which lies within a projection of the periphery of the PTC resistive element. The shaped portion serves to improve thermal transfer between the PTC element and the atmosphere surrounding the device. Devices of the invention are useful as circuit protection devices.

20 Claims, 3 Drawing Sheets

ELECTRICAL DEVICE

CROSS-REFERENCE TO RELATED APPLICATIONS

This application is continuation of copending, commonly assigned application Ser. No. 07/837,527 (Chan et al), filed Feb. 18, 1992, which is a a continuation-in-part of commonly assigned application Ser. No. 07/590,114 (Chan et al), filed Sep. 28, 1990, now U.S. Pat. No. 5,089,801, issued Feb. 18, 1992, the disclosure of which is incorporated herein by reference.

BACKGROUND OF THE INVENTION

1. Field Of the Invention

This invention relates to electrical devices and methods for making them, particularly electrical devices which are suitable for use as circuit protection devices.

2. Introduction to the Invention

Electrical devices for use in protecting against overvoltage or over-temperature conditions in a circuit are well known. Such circuit protection devices frequently comprise materials which exhibit a positive temperature coefficient of resistance, i.e. PTC behavior, and thus act to shut down a circuit if conditions are unsafe by increasing in resistance by orders of magnitude from a normal, low temperature value. Devices of this type may comprise an inorganic material, e.g. $BaTiO_3$, or a conductive polymer composition. For any material, the time required for the device to switch into its high temperature, high resistance state, i e to "trip" is a function of the resistivity of the material, the geometry of the device, and the thermal environment. Similarly, the time required for the device to cool down from its high temperature, high resistance state, i.e. to "reset", is also a function of the material, the geometry of the device, and the thermal environment. It is generally preferred that the resistance of the device at 23° C. be as low as possible in order to contribute as little resistance as possible to the circuit during normal, low temperature operation. For most low voltage applications, i.e. 60 volts or less, devices of planar geometry are preferred. Such planar devices comprise a laminar resistive element which is electrically connected to two laminar electrodes. For a material of a given resistivity, planar devices of specified area will have the lowest resistance when the distance between the electrodes, i.e the current path length, is the smallest. Therefore, thin devices are preferred and result in lower resistances, lower materials requirements, and smaller "real estate" requirements for a printed circuit board.

There are problems, however, with thin laminar devices. When the device trips into its high resistance state, heat is generated by $I^2R$ heating. Because of the relatively small thermal mass of a thin device, it tends to dissipate the heat rapidly and to trip rapidly. Such rapid tripping is not desirable for all applications. For example, when a device is designed to protect a motor used to raise or lower a window, for example in an automobile, the device heats as the motor operates. It is necessary that the window be fully opened or closed before the device heats sufficiently to cause it to trip. Therefore, a relatively long trip time is needed when compared to many conventional applications. One technique to increase the trip time is to increase the size of the device. This, however, is undesirable if the space available for the device is limited. Another technique to increase the trip time is to increase the thermal mass by electrically and physically attaching elements of high thermal mass, e.g. metal terminal plates, to the device. Alternatively, the laminar electrodes themselves may comprise relatively thick, high thermal mass material. Such electrodes are described in European Patent Publication No. 363,746 (Asea Brown Boveri, published Apr. 18, 1990), the disclosure of which is incorporated herein by reference.

SUMMARY OF THE INVENTION

While the use of high thermal mass electrodes or terminals can influence the rate at which the device trips, it will also influence the rate at which the device cools and can be reset. Delayed reset time is undesirable for applications, such as motors controlling the raising or lowering of a window, in which it is necessary that once the fault condition is cleared, the motor immediately be able to operate correctly. In a first aspect, this invention relates to an electrical device which comprises electrical device which comprises (1) a laminar resistive PTC element which
  (a) is composed of a PTC conductive polymer, and
  (b) has a first periphery; and
(2) a conductive terminal comprising
  (a) a laminar portion which is secured directly or indirectly to a first face of the resistive PTC element, and
  (b) a non-laminar shaped portion which (i) lies within a projection of the first periphery and (ii) improves thermal transfer between the PTC element and the atmosphere surrounding the device.

In a second aspect, this invention relates to an assembly which comprises (a) a device according to the first aspect of the invention, and
(b) a substrate to which the device is attached.

BRIEF DESCRIPTION OF THE DRAWING

The invention is illustrated by the drawing in which.

DETAILED DESCRIPTION OF THE INVENTION

Figure 1:
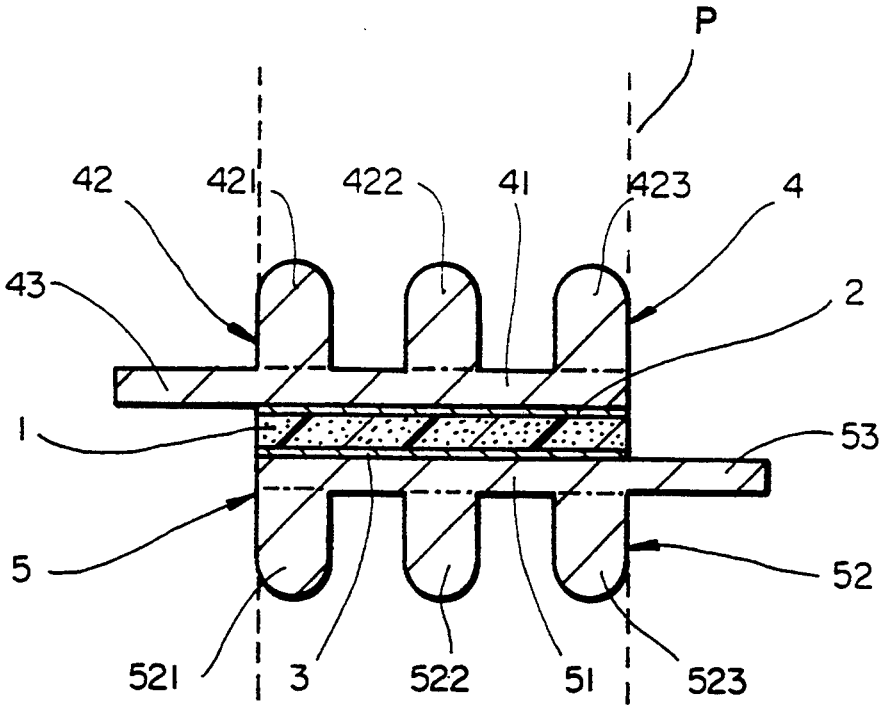
FIGS. 1 and 2 are cross-sectional and plan views, respectively, of a first device of the invention.

The electrical device of the invention comprises a laminar resistive element which may be of any shape, e.g. rectangular, round, or square, and which has a first periphery, i.e. the maximum distance around the edge (the perimeter) of the element. The resistive element is composed of a first material having a first resistivity at 23° C. Suitable materials include inorganic compositions such as $BaTiO_3$, and conductive polymer compositions. Such conductive polymer compositions comprise a particulate conductive filler which is dispersed or otherwise distributed in a polymeric component. The polymeric component may be an organic polymer, preferably a crystalline organic polymer, an amorphous thermoplastic polymer, an elastomer, or a blend comprising one or more of these. Suitable crystalline polymers include polymers of one or more olefins, particularly polyethylene; copolymers of at least one olefin and at least one monomer copolymerisable therewith, such as ethylene/acrylic acid, ethylene/ethyl acrylate, and ethylene/vinyl acetate copolymers; melt-shapeable fluoropolymers such as polyvinylidene fluoride; and blends of two or more such crystalline polymers. Dispersed or distributed in the polymeric component is a particulate conductive filler which may be, for example, carbon black, graphite, metal, metal oxide, particulate conductive polymer, or a combination of these. The quantity of conductive filler needed is based on the required resistivity of the first material which depends on the desired application and the geometry of the electrical device. When, as is preferred, the device functions as a circuit protection device, a resistance at 23° C. of 0.001 to 100 ohms is usually required. For this type of application, when the first material is a conductive polymer composition, the resistivity at 23° C. is 0.001 to 1000 ohm-cm, preferably 0.005 to 500 ohm-cm, particularly 0.01 to 100 ohm-cm, e.g. 0.1 to 25 ohm-cm.

When the first material comprises a conductive polymer composition, additional components such as inert fillers, antioxidants, chemical crosslinking agents, stabilizers, or dispersing agents may be present.

For many applications, it is desirable that the first material exhibit PTC behavior. The term "PTC behavior" is used in this specification to denote a composition or an electrical device which has an $R_{14}$ value of at least 2.5 and/or an $R_{100}$ value of at least 10, and it is particularly preferred that the composition should have an $R_{30}$ value of at least 6, where $R_{14}$ is the ratio of the resistivities at the end and the beginning of a 14° C. temperature range, $R_{100}$ is the ratio of the resistivities at the end and the beginning of a 100° C. range, and $R_{30}$ is the ratio of the resistivities at the end and the beginning of a 30° C. range. When the first material is a conductive polymer composition which exhibits PTC behavior, crystalline organic polymers are preferred. Suitable conductive polymer compositions may be found in U.S. Pat. Nos. 4,237,441 (van Konynenburg et al), 4,304,987 (van Konynenburg), 4,388,607 (Toy et al), 4,514,620 (Cheng et al), 4,534,889 (van Konynenburg et al), 4,545,926 (Fouts et al), 4,560,498 (Horsma et al), 4,591,700 (Sopory), 4,724,417 (Au et al), 4,774,024 (Deep et al), and 5,049,850 (Evans et al). The disclosure of each of these patents is incorporated herein by reference.

The device of the invention also comprises both a laminar portion and a non-laminar shaped portion. The conductive terminal. The conductive terminal comprises a laminar portion is secured to the laminar resistive PTC element (or as described hereafter, to a face of the conductive element remote from the resistive element) and is composed of a third material having a third resistivity at 23° C. which is substantially lower than the first resistivity. The laminar portion of the conductive terminal is preferably a laminar metal sheet which comprises one or more metal layers, although for some applications, it may be a metal mesh or screen, a fabric containing a metal fiber, or a layer formed from a conductive ink. When the laminar portion of the terminal is a metal sheet, the type of metal depends on the thermal, electrical, environmental, and cost requirements for the device. Different layers may be present in order to meet different requirements and it is often preferred that the laminar interior surface layer, i.e. that surface in contact with the PTC resistive element or the conductive element, and the exterior surface layer be different. For example, devices which are to be soldered to a circuit board or to another component may require an exterior surface layer of copper, brass, or tin, while devices to be welded would require copper rather than tin which would contaminate the welding electrodes. For devices to be used in a corrosive environment, nickel may be suitable. A preferred terminal comprises copper-coated steel. It is also possible that the shape and/or texture of the interior and exterior surface layers be different in order to meet different requirements. Thus one surface may be an electrodeposited layer which comprises nodules suitable for enhanced adhesion to the conductive element.

The terminal also comprises a non-laminar shaped portion which lies within a projection of the first periphery of the PTC resistive element and which improves thermal transfer between the PTC element and the atmosphere surrounding the device. Such improvement would be readily observed if a device comprising a terminal consisting solely of a laminar portion and a device comprising a terminal consisting of both a laminar and a non-laminar shaped portion were compared. The non-laminar shaped portion may have any suitable shape. For example, the shaped portion may be in the form of one or more fins which extend outward away from the PTC element. The base of the fin remains within the first periphery. If more than one fin is present, some or all of the fins may be connected to one another, either only at the base of the fin by the laminar portion, or elsewhere on the extension of the fin by means of a cross-member. Such fins provide improved convection of heat from the device. Regardless of the shape of the shaped portion, the surface area of the shaped portion of the terminal exposed to the atmosphere is at least 1.5 times, preferably at least 2 times, particularly at least 4 times, especially at least 6 times, e.g. at least 8 times or more, the area of the laminar portion secured to the PTC element.

The thickness of the terminal is affected by the thermal requirements of the device. In general, it is preferred that the terminal have a thickness of at least 0.002 inch (0.005 cm), preferably at least 0.005 inch (0.0127 cm), particularly at least 0.010 inch (0.025 cm), especially at least 0.015 inch (0.038 cm), e.g. 0.020 inch (0.051 cm), but that it have a thickness of less than 0.100 inch (0.254 cm), preferably less than 0.080 inch (0.203 cm), in order to prevent the restriction of any necessary expansion of the resistive element. The shaped portion of the terminal is not included in determining the thickness of the terminal.

The conductive terminal has a third periphery which may or may not lie, at least in part, within the first periphery. Portions of the third periphery which lie outside the first periphery may be used for making electrical contact from the electrical device to a circuit board or an electrical lead. Therefore, it is common that "tabs" for welding or otherwise connecting the terminal to a source of electrical power, extend beyond the first periphery. The third periphery, which is equivalent to the edge of the conductive terminal, may be shaped in any way which is suitable for the application and which will allow the terminal to be positioned correctly with respect to the resistive element and the conductive element. It is generally desired that the amount of metal in contact with the conductive element be maximized in order to maximize the thermal mass of the device and minimize any areas of high current concentration which result from a nonuniform contact between the terminal and the resistive element (or the electrode attached to the resistive element).

For some applications it is preferred that the device comprise two conductive terminals, one secured to a conductive element on each laminar face of the resistive element. For some applications it is preferred that the first and the second conductive terminals have the same shape, although for other applications, e.g. where it is desired that the device be mounted flush with a substrate, it may be preferred that the first and second conductive terminals have different shapes, and/or different types of shaped portions.

In some embodiments of the device, a laminar conductive element is secured to the surface of the resistive element so that there is physical and electrical contact between the two elements. The conductive element is composed of a second material having a second resistivity at 23° C. which is substantially lower than the first resistivity. In this application, when a material is said to have a resistivity which is substantially lower than the first material, it means that the resistivity is at least 10 times less, preferably at least 50 times less, particularly at least 100 times less than the resistivity of the first material at 23° C. The conductive element has a second periphery which does not extend beyond the first periphery, i.e. it may be entirely within the first periphery or may coincide with the first periphery. It is also preferred that the second material be thermally conductive in order to enhance the flow of heat from the resistive element to the conductive terminal. Many conductive materials may be used for the conductive element, e.g. conductive inks, conductive pastes, or conductive epoxies. For many applications, however, it is preferred that the second material is solder, which can be readily applied, attached to and form an electrical connection between the laminar resistive element and the conductive terminal. The appropriate type of solder depends on the properties of the material comprising the resistive element. For example, a tin eutectic solder which can be melted and reflowed at a relatively low temperature is suitable for use with conductive polymer resistive elements comprising polyethylene. Other, higher melting solders, such as silver-based solders, may be used with resistive elements comprising higher melting polymers or inorganic materials. When solder is used, it may be applied to either the surface of the resistive element (or any attached electrode) or the surface of the conductive terminal, or both, preferably in the form of solder paste. The composite is then heated in a solder reflow furnace (which may be an infrared oven, a hot air oven, or a vapor phase reflow oven) to melt and reflow the solder. After the solder is cooled, a bond is formed between the various elements.

While it is possible to attach the conductive element directly to the resistive element, for most applications it is preferred that the conductive element be attached to a laminar electrode which itself is attached to the resistive element. The laminar electrode is composed of a fourth material having a fourth resistivity at 23° C. which is substantially lower than the first resistivity. The fourth material is generally a laminar metal foil such as copper or nickel, particularly an electrodeposited metal foil which has a nodular surface for enhanced adhesion to a conductive polymer or other substrate. Electrodes of this type, and devices comprising them, are described in U.S. Pat. Nos. 4,689,475 (Matthiesen) and 4,800,253 (Kleiner et al), the disclosures of which are incorporated herein by reference. Alternatively, the laminar electrode may comprise a conductive ink, a conductive epoxy, or a metal layer deposited by flame-spray techniques or vacuum deposition. When two laminar electrodes are secured to the two laminar faces of a resistive element, an electrical device is formed. Devices of this type are disclosed in U.S. Pat. Nos. 4,238,812 (Middleman et al), 4,255,798 (Simon), 4,272,471 (Walker), 4,315,237 (Middleman et al), 4,317,027 (Middleman et al), 4,330,703 (Horsma et al), 4,426,633 (Taylor), 4,475,138 (Middleman et al), 4,724,417 (Au et al), 4,780,598 (Fahey et al), 4,845,838 (Jacobs et al), 4,907,340 (Fang et al), and 4,924,074 (Fang et al), the disclosure of each of which is incorporated herein by reference.

The laminar electrode lies between the resistive element and the conductive element and is secured to both the resistive element and the conductive element. It has a fourth periphery, at least a part of which substantially follows at least a part of the first periphery. For many applications, the fourth periphery does not extend beyond the first periphery, and it is preferred that the fourth periphery coincide with the first periphery.

Devices of the invention can be prepared by a method in which a conductive material such as a solder paste or conductive epoxy is applied to a laminar surface of the resistive element. A conductive terminal is then positioned on the conductive material in a selected position. The conductive terminal is then electrically and physically attached to the resistive element, e.g. by reflowing and cooling the solder or curing the epoxy.

For some applications, it may be desirable to make the solder flow in a nonuniform manner in order to direct any excess solder into specific reservoirs. Under these conditions, the conductive terminal may be prepared with an indented or notched edge in a specific region of the periphery. Alternatively, for conductive terminals which comprise a tab for electrical connection, a reservoir or channel at the point where the tab contacts the conductive terminal may be desirable.

Devices of the invention can be used to form an assembly by physically and/or electrically connecting one or more devices to a substrate. For many applications, the substrate is a printed circuit board. The improvement in thermal transfer can be affected by the relative position of the device and the substrate. In this specification, when a device or a substrate is described as substantially horizontal or substantially vertical, it means that the device or the substrate is within 20° of horizontal or vertical position, respectively. Similarly, when a device is described as substantially parallel to or substantially at right angles to the substrate, it means that the device is within 20° of the parallel or right angle position of the substrate, respectively. In situations where the substrate is positioned substantially vertical, the device may be mounted either substantially parallel to or substantially at right angles to the plane of the substrate and still achieve improved thermal transfer. If, however, the substrate is substantially horizontal, it is desirable that the plane of the PTC element is substantially parallel to the plane of the substrate and the fins or other shaped portion extend from the face of the PTC resistive element remote from the substrate. Alternatively, if the substrate is substantially horizontal, it is preferred that the plane of the PTC element is substantially at right angles to the plane of the substrate.

Figure 2:
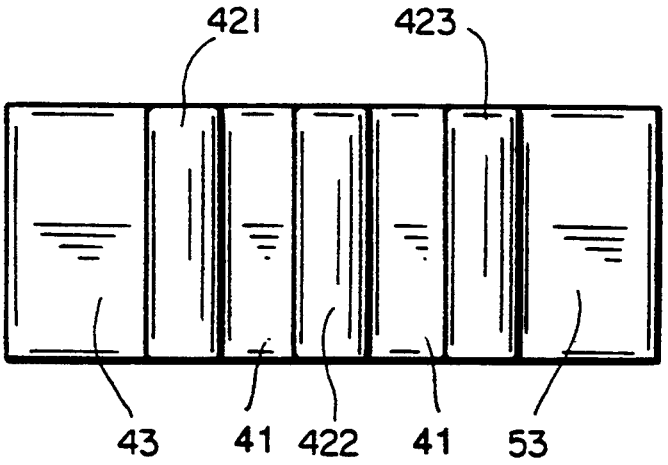

Referring now to the drawings, each of FIGS. 1, 3, 5, and 6 shows in cross-section a device of the invention which comprises a planar PTC conductive polymer element 1 which is sandwiched between two metal foil electrodes 2 and 3. The projection of the first periphery of PTC element 1 is shown by dashed lines identified as P which extend from the edges of PTC element 1. In FIG. 1, terminals 4 and 5 are secured to the outer faces of electrodes 2 and 3, respectively, by layers of solder (not shown). Terminals 4 and 5 have laminar portions 41,51, respectively, and non-laminar shaped portions 42, 52, respectively. Each of non-laminar shaped portions 42, 52 has three separate fins, 421, 422, 423, and 521, 522, 523, respectively, which are directly attached to and extend from the laminar portions. The laminar portions 41, 51 also comprise extending tabs 43, 53, respectively, which are suitable for making electrical connection to the device. FIG. 2 shows a plan view of the device of FIG. 1. The first periphery of PTC element 1 is shown by the left side of fin 421, the right side of fin 423, and the edges which connect them.

Figure 3:
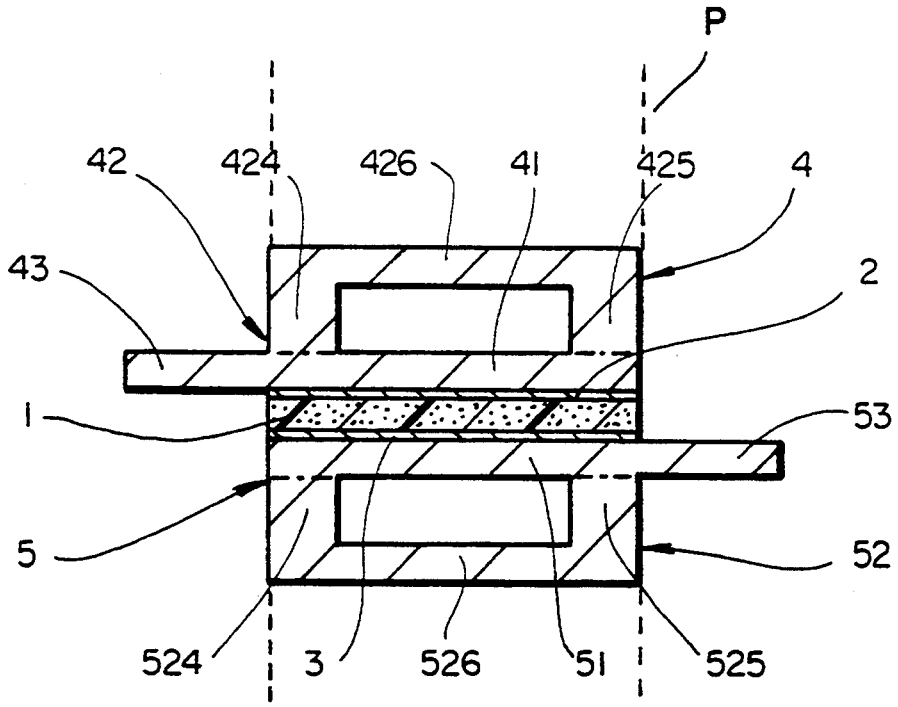
FIGS. 3 and 4 are cross-sectional and plan views, respectively, of a second device of the invention.
Figure 4:
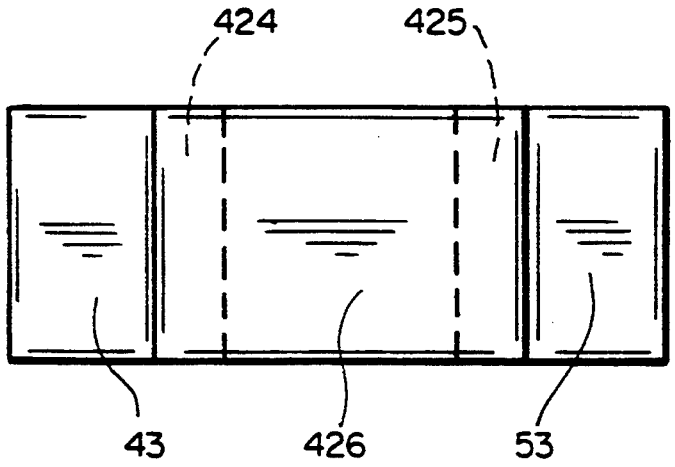

In FIG. 3, terminals 4 and 5 are in the form of laminar portions 41, 51, respectively, to which are attached two fins 424, 425, and 524, 525, which are connected by a cross-member 426, 526. Also present are extending tabs 43, 53. FIG. 4 shows a plan view of the device of FIG. 3. In FIG. 4, the first periphery of PTC element 1 is shown by the left side of fin 424, the right side of fin 425, and the edges which connect them by cross-member 426.

Figure 5:
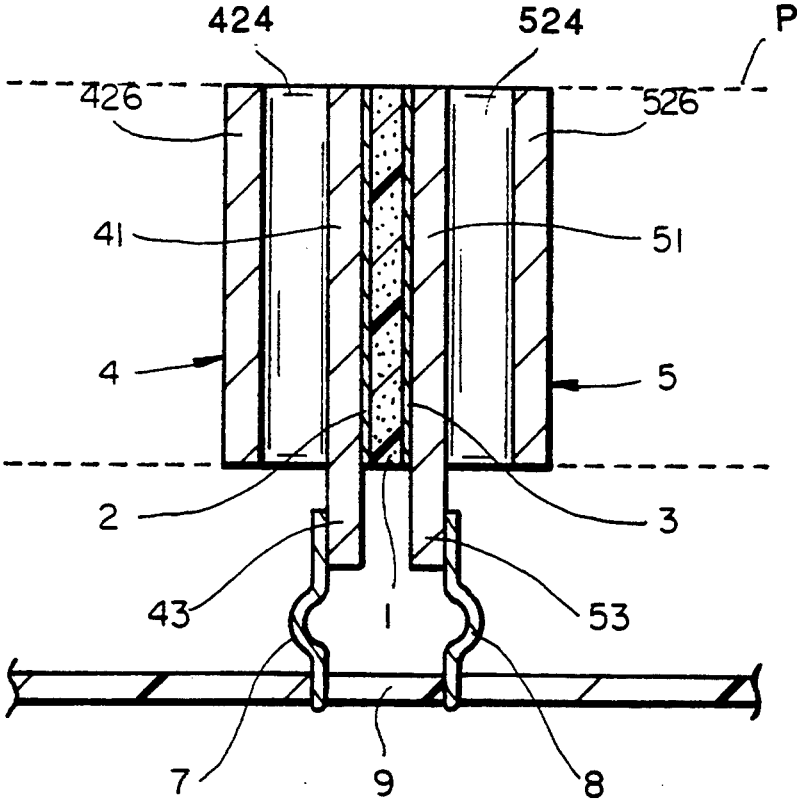
FIGS. 5 and 6 are cross-sectional views of assemblies of the invention showing devices of the invention mounted on a circuit board.

FIG. 5 is a cross-sectional view of a device of the invention in which the PTC conductive polymer element 1 is attached to metal foil electrodes 2, 3 and is secured to laminar portions 41, 51 of terminals 4, 5, respectively. The non-laminar shaped portion of terminals 4, 5 comprises two fins 424, 425, and 524, 525, respectively (only 424 and 524 are shown in FIG. 5), which are connected by cross-members 426, 526. Extending tabs 43, 53 are secured, e.g. welded, to leads 7, 8, respectively, and the leads pass through orifices in an insulating substrate 9 and connect to electrical traces printed on the substrate. The leads are so constructed and shaped that their fixed location in the substrate does not prevent expansion of the PTC element.

Figure 6:
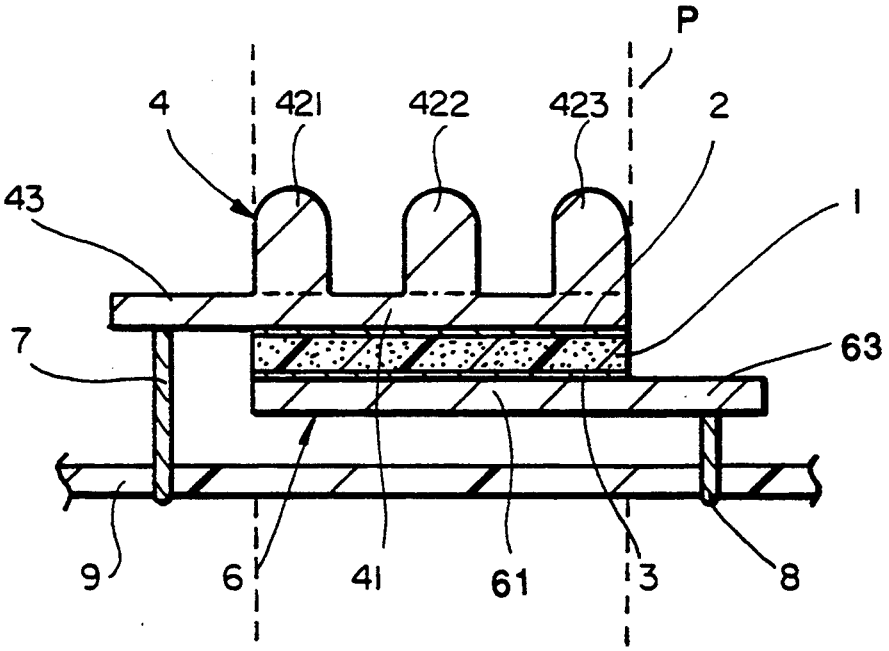

FIG. 6 is a cross-sectional view of another device of the invention. In this device, electrode 2 of PTC conductive polymer element 1 is connected to terminal 4 which comprises laminar portion 41 and non-laminar shaped portion 42 which comprises fins 421, 422, 423 which extend from laminar portion 41. Electrode 3 is attached to terminal 6 which has a laminar portion 61 and a tab 63, but no shaped portion. As in FIG. 5, tabs 43 and 63 are secured to leads 7, 8, which are connected to an insulating substrate 9, e.g. a printed circuit board.

What is claimed is:

1. A circuit protection device which comprises
(1) a laminar resistive PTC element which has a resistance at 23° C. of 0.001 to 100 ohms and which
  (a) is composed of a PTC conductive polymer which has a resistivity at 23° C. of 0.01 to 100 Ohm-cm, and
  (b) has a first periphery; and
(2) a conductive terminal comprising
  (a) a laminar portion which is secured directly or indirectly to a first face of the resistive PTC element, and
  (b) a non-laminar shaped portion which (i) lies within a projection of the first periphery and (ii) improves thermal transfer between the PTC element and the atmosphere surrounding the device.

2. A device according to claim 1 which includes a second terminal which comprises a laminar portion which is secured directly or indirectly to the opposite face of the PTC element.

3. A device according to claim 2 wherein the second terminal comprises a non-laminar shaped portion which (i) lies within a projection of the first periphery and (ii) further improves thermal transfer between the PTC element and the atmosphere surrounding the device.

4. A device according to claim 1 wherein the surface area of the shaped portion of the terminal exposed to the atmosphere is at least 1.5 times the area of the laminar portion secured to the PTC element.

5. A device according to claim 4 wherein the surface area of the shaped portion of the terminal exposed to the atmosphere is at least 2 times the area of the laminar portion secured to the PTC element.

6. A device according to claim 5 wherein the surface area of the shaped portion of the terminal exposed to the atmosphere is at least 4 times the area of the laminar portion secured to the PTC element.

7. A device according to claim 1 wherein the non-laminar shaped portion comprises at least one fin which extends outwards away from the PTC element within the periphery thereof.

8. A device according to claim 7 wherein there are at least two fins and the fins are connected to each other only by the laminar portion.

9. A circuit protection device which comprises
(1) a laminar resistive PTC element which
  (a) is composed of a PTC conductive polymer, and
  (b) has a first periphery; and
(2) a conductive terminal comprising
  (a) a laminar portion which is secured directly or indirectly to a first face of the resistive PTC element, and
  (b) a non-laminar shaped portion which (i) lies within a projection of the first periphery, (ii) improves thermal transfer between the PTC element and the atmosphere surrounding the device, and (iii) comprises at least two fins which extend outwards away from the PTC element within the periphery thereof and at least two fins which are connected to each other by a cross-member.

10. A device according to claim 1 which includes a laminar conductive element which
(a) is secured to a face of the resistive element, and
(b) has a second periphery which does not extend beyond
the first periphery.

11. A device according to claim 10 wherein the conductive element comprises solder.

12. A device according to claim 10 which includes a laminar electrode which
(a) lies between the resistive element and the conductive element and is secured to the resistive element and the conductive element, and
(b) has a fourth periphery.

13. A device according to claim 12 wherein the laminar electrode is a metal foil electrode.

14. A device according to claim 13 wherein the laminar electrode has an electrodeposited metal surface, which surface is in contact with the resistive element.

15. An assembly which comprises
(A) a circuit protection device which comprises
  (1) a laminar resistive PTC element which has a resistance at 23° C. of 0.001 to 100 ohms and which (a) is composed of a PTC conductive polymer which has a resistivity at 23° C. of 0.01 to 100 ohm-cm, and (b) has a first periphery; and (2) a conductive terminal comprising (a) a laminar portion which is secured directly or indirectly to a first face of the resistive PTC element, and (b) a non-laminar shaped portion which (i) lies within a projection of the first periphery and (ii) improves thermal transfer between the PTC element and the atmosphere surrounding the device, and (B) a substrate to which the device is attached.

16. An assembly according to claim 15 wherein (a) the substrate is substantially horizontal, and (b) the plane of the PTC resistive element is substantially parallel to the substrate and the shaped portion of the terminal comprises fins which extend from the face of the PTC resistive element remote from the substrate.

17. An assembly according to claim 15 wherein (a) the substrate is substantially horizontal, and (b) the plane of the PTC resistive element is substantially at right angles to the plane of the substrate.

18. An assembly according to claim 15 wherein the substrate is substantially vertical.

19. A circuit which comprises (A) a circuit protection device which comprises (1) a laminar resistive PTC element which has a resistance at 23° C. of 0.001 to 100 ohms and which (a) is composed of a PTC conductive polymer which has a resistivity at 23° C. of 0.01 to 100 ohm-cm, and (b) has a first periphery; and (2) a conductive terminal comprising (a) a laminar portion which is secured directly or indirectly to a first face of the resistive PTC element, and (b) a non-laminar shaped portion which (i) lies within a projection of the first periphery and (ii) improves thermal transfer between the PTC element and the atmosphere surrounding the device, and (B) a power source, and (C) and electrical load.

20. A circuit according to claim 19 wherein the non-laminar shaped portion of the circuit protection device comprises at least two fins which extend outwards away from the PTC element within the periphery thereof and which are connected to each other by a cross-member.

* * * * *

UNITED STATES PATENT AND TRADEMARK OFFICE

CERTIFICATE OF CORRECTION

PATENT NO. : 5,436,609
DATED : July 25, 1995
INVENTOR(S) : Chan et al

It is certified that error appears in the above-indentified patent and that said Letters Patent is hereby corrected as shown below:

Column 2, Line 20, delete "electrical device which comprises"

Column 3, Lines 46 & 47, delete "both a laminar portion and a non-laminar shaped portion. The" and insert --a--.

Column 3, Line 47, delete "a" and insert --both a laminar portion and a non-laminar shaped portion. The--.

Signed and Sealed this

Fifth Day of December, 1995

*Attest:*

Bruce Lehman

BRUCE LEHMAN

*Attesting Officer*

*Commissioner of Patents and Trademarks*